United States Patent [19]

Rathbun

[11] Patent Number: 4,608,846

[45] Date of Patent: Sep. 2, 1986

[54] DEDIMPLER APPARATUS

[75] Inventor: Melvin R. Rathbun, Huntley, Ill.

[73] Assignee: Lemont Machine Company, Lincolnwood, Ill.

[21] Appl. No.: 739,207

[22] Filed: May 30, 1985

[51] Int. Cl.[4] ..... B21D 41/02

[52] U.S. Cl. ..... 72/111; 72/419; 72/424

[58] Field of Search ..... 72/110, 111, 419, 424; 198/774

[56] References Cited

U.S. PATENT DOCUMENTS

| | | | |
|---|---|---|---|
| 863,841 | 8/1907 | George | 198/774 |
| 2,941,567 | 6/1960 | Simborg | 72/111 |
| 2,966,193 | 12/1960 | Fischer | 72/111 |
| 3,554,363 | 1/1971 | Elineau | 198/774 |

*Primary Examiner*—Lowell A. Larson
*Attorney, Agent, or Firm*—John S. Fosse

[57] ABSTRACT

Tube dedimpler apparatus is provided with a walking-beam conveyor in which parallel disposed walking-beams are directed through closed, congruent, vertical, workpiece-transfer paths using paired crank arms which are driven in unison by means including respective stepping motors operated in the full-step mode.

11 Claims, 8 Drawing Figures

DEDIMPLER APPARATUS

FIELD OF THE INVENTION

This invention relates generally to parts-handling equipment, more particularly to equipment for handling cut lengths of metal tubing, and especially to tube mill equipment for feeding pre-cut lengths of tubing to a dedimpling operation.

BACKGROUND OF THE INVENTION

In the past, machinery has been developed for the production of substantially continuous lengths of metal tubing of various wall thicknesses; and in order to facilitate the packaging, transportation and use of such tubing, auxiliary equipment has been designed to sever the substantially continuous tubing into standard lengths. However, certain cut-off mills generate a constriction or "dimple" adjacent the cut ends of the tubing. This defect is particularly pronounced in lighter gauge materials and, in many applications, has been found to be grossly unacceptable.

Dedimpler apparatus has, as a consequence, been developed heretofore for re-sizing the cut ends of the tubing; and in one form of such apparatus, a coacting pair of conical dedimpler plugs or tools is rotatably and convergibly driven to engage and penetrate the open ends of the tube length. This action of the dedimpler plugs forcibly restores the tube to a condition of being cylindrically true. Such dedimpling apparatus ordinarily includes, in addition, a tube-backing pressure roller that is aligned radially with each of the dedimpler tools in order to support the tube against the dedimpler tools and prevent flaring of the cut ends.

Conventional gravity feed arrangements for such dedimpler apparatus have proved to be a bottleneck in modern tube mills and have prevented such equipment from reaching optimum efficiency.

Therefore, an important object of the present invention is to provide a high-speed, precision tube-feeding mechanism for use with dedimpling apparatus.

A more general object of the invention is to provide new and improved dedimpling apparatus which is characterized by maximized output rates.

A further object of the invention is to provide dedimpler apparatus and the like with a workpiece feed mechanism of the walking-beam type.

These and other objects and features of the invention will become apparent from a consideration of the following disclosure.

BRIEF DESCRIPTION OF THE DRAWINGS

The invention, both as to its construction and its mode of operation, will be better understood by reference to the following disclosure and drawings forming a part thereof, wherein.

DETAILED DESCRIPTION OF THE INVENTION

Figure 1:
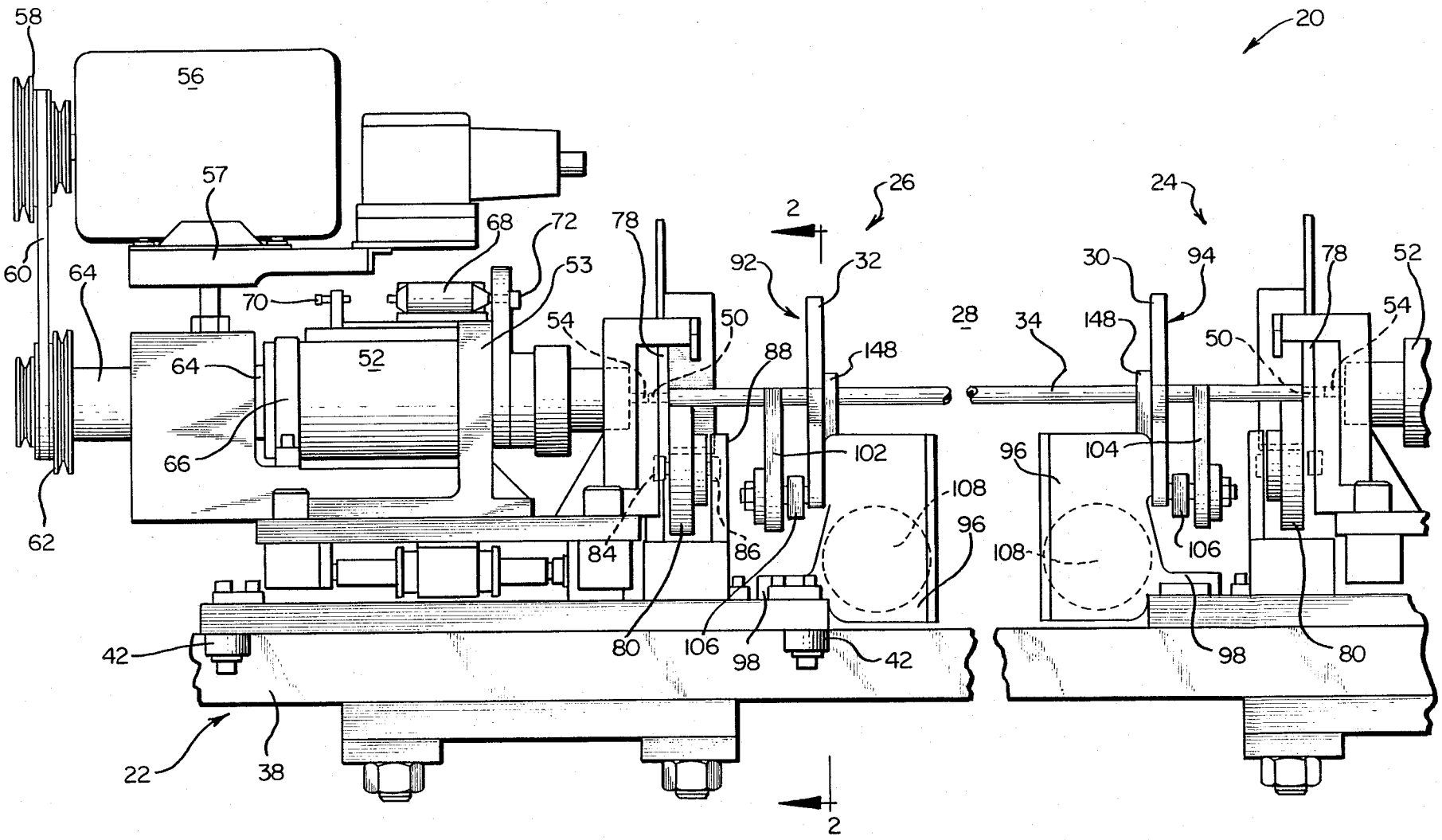
FIG. 1 is a side elevational view of dedimpler apparatus incorporating a walking-beam transfer mechanism in compliance with the invention.

Referring now in detail to the drawings and giving first attention to FIG. 1, dedimpler apparatus which is indicated generally by the reference numeral 20 comprises a machine frame 22, a fixed machine head 24, and a movable machine head 26 which cooperates with the fixed machine head 24 in defining a work station 28 where dedimpling is caused to take place. In addition, the dedimpler apparatus 20 comprises declined, parallel feed ramps 30 and 32 which receive and gravitationally convey a sequence of cut lengths 34 of cylindrical metal tubing from a conventional tube mill, not shown, to a selectively positionable tube stop 36, best seen in FIG. 2.

Figure 2:
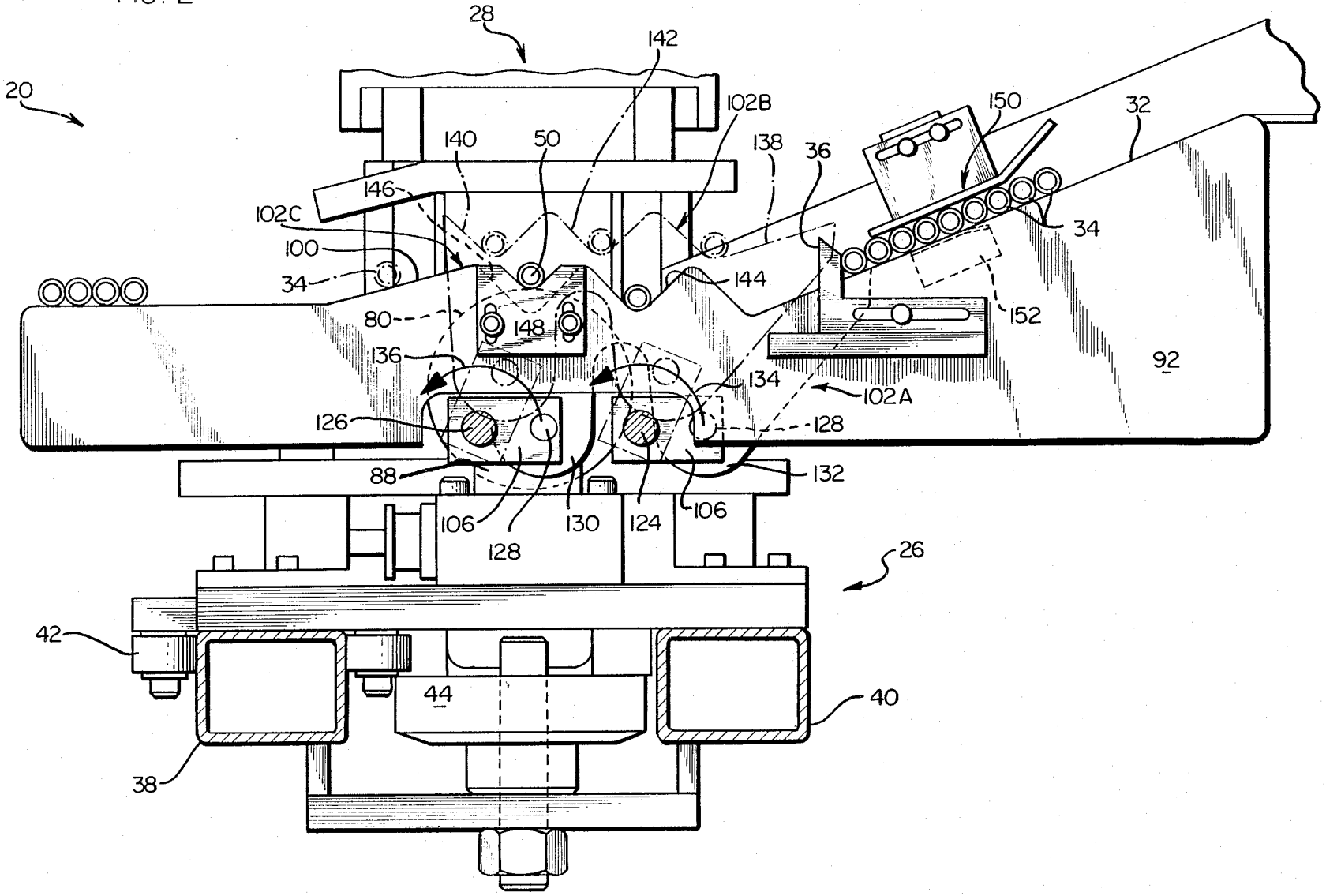
FIG. 2 is an end elevational view taken substantially along the Line 2—2 of FIG. 1 to show parts of the walking-beam transfer mechanism and the cooperating, stationary, tube-guide plate.

Continuing with reference to FIG. 2, the machine frame 22 includes a pair of horizontally extending, laterally spaced, rectangularly tubular rails 38 and 40; and considering FIG. 1, the fixed machine head 24 is bolted to the base which is defined generally by the frame rails 38 and 40. Returning to FIG. 2, the movable machine head 26, on the other hand, is cooperatively guided along the rails 38 and 40 by spaced rollers 42, to be held in position at a selected distance from the fixed head 24 by means including a conventional air clamp 44. As will be appreciated, the selected spacing of the heads 24 and 26 is determined by the particular length of cut tubing 34 being processed at a given time.

The machine heads 24 and 26 are substantially identically comprised in mirror image of each other; and it is therefore to be understood that the following description of the components of both the dedimpler and the tubing transfer schemes, given with reference to the movable head 26, is likewise applicable to the fixed head 24.

Figure 3:
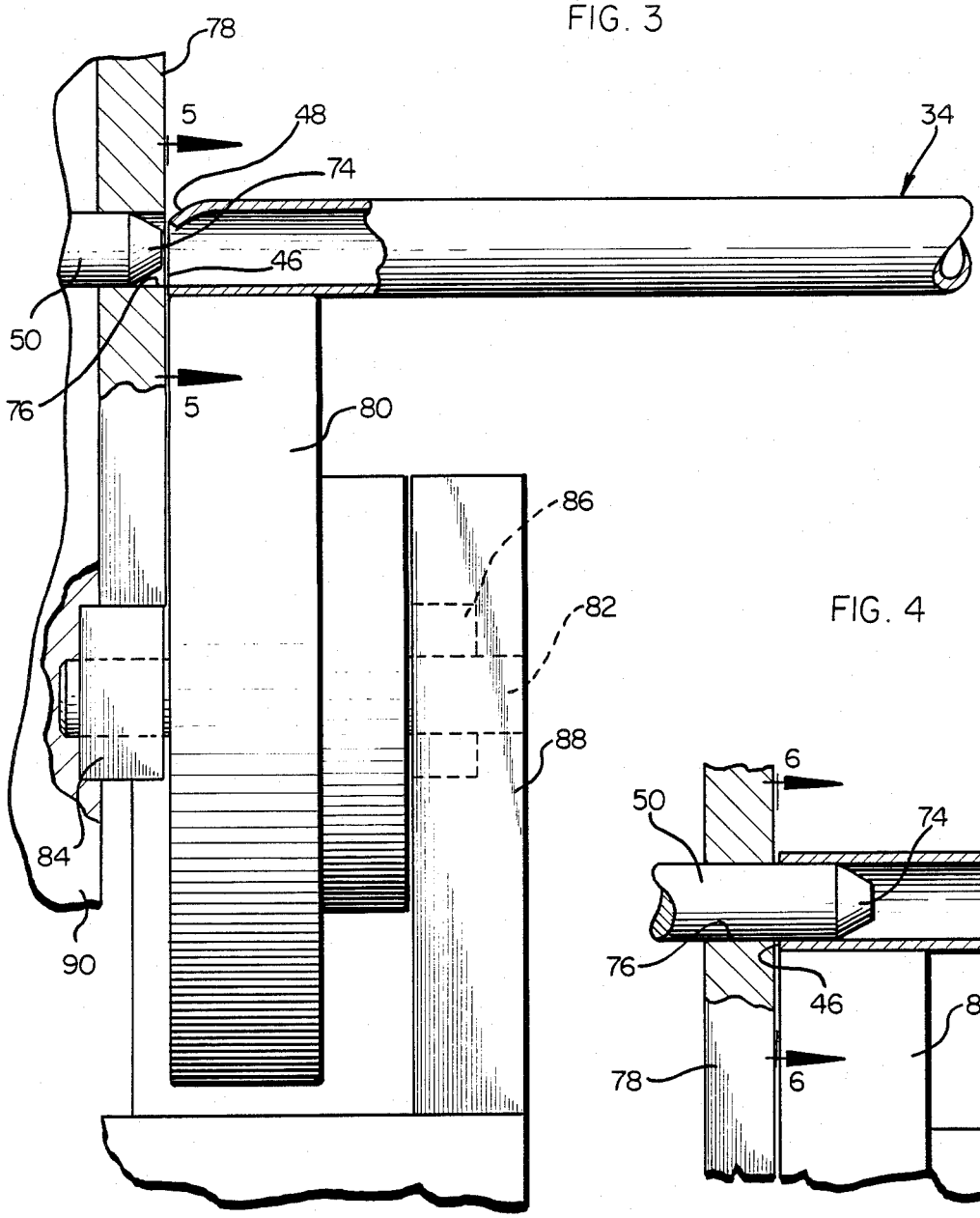
FIG. 3 is an enlarged side elevational view of a dedimpler tool and cooperating tubing backup pressure roller which are employed in the apparatus of FIGS. 1 and 2, showing the dedimpler tool advancing toward the dimpled end of a cut length of tubing.
Figure 5:
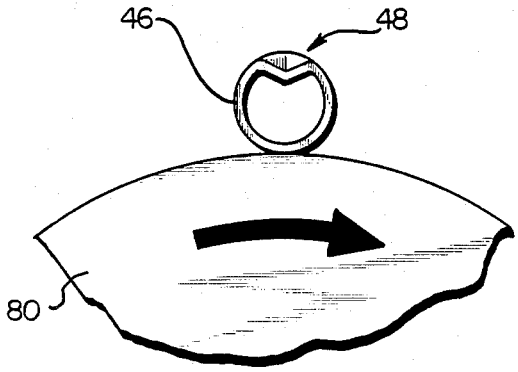
FIG. 5 is a view taken substantially along the Line 5—5 of FIG. 3.
Figure 6:
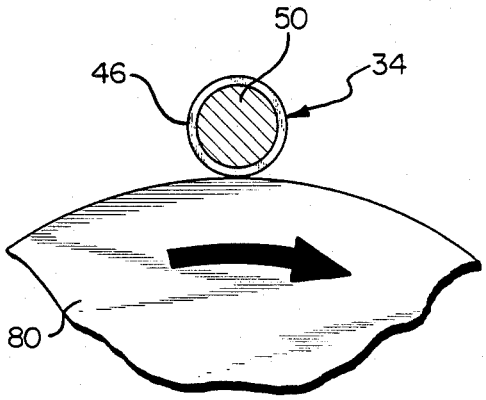
FIG. 6 is a view taken substantially along the Line 6—6 of FIG. 4.

Referring briefly to FIGS. 3 and 5, a cut end 46 of a given length of the tubing 34 is seen indented with a dimple 48 which has been created by the impact of a severing tool used in cutting lengths from the substantially endless tube advancing from the tube mill.

In order to restore cylindrical shape to the cut ends 46 of the tube length 34, the machine heads 24 and 26 are provided with aligned dedimpler plugs or tools 50, indicated generally in FIG. 1; and the tools 50 are rotatably and selectively convergibly driven by means including individual pneumatic-actuated cylinders 52 which are mounted on the respective machine heads by means including a bracket 53. Each cylinder 52 incorporates an internal, reciprocably operable spindel 54 which is turned by the rotary force from an electrically energized, dedimpler drive motor 56, motor 56 being positioned on the machine head by means including a bracket 57.

Each of the tools 50 is securely fastened on the corresponding spindel 54 to rotate and reciprocate therewith; and rotation is transmitted to the spindel 54 from the drive motor 56 by means including a drive pulley 58 which is mounted on the output shaft of the motor, a flexible endless belt 60, a driven pully 62 which is fastened on a sleeve take-off 64 in the rear housing 66 of the cylinder 52, and a splined connection between the spindel and the driven pulley shaft. Reciprocal motion toward and away from the work station 28 is imparted to the spindel by pneumatic actuation of the cylinder 52; and one useful embodiment of the cylinder 52 is found in the commercially available unit designated "HyPneuMat Model DQ" sold by HYPNEUMAT INC., of Milwaukee, Wisc., to which reference is made for completeness of the present disclosure.

A double-head limit switch 68 is mounted to reciprocate with the spindel 54 between adjustable stops 70 and 72 in order to sense the outstroke and instroke of the dedimpler tools 50 and to initiate and terminate cycling of the walking-beam transfer mechanism, as will be described hereinbelow.

Figure 4:
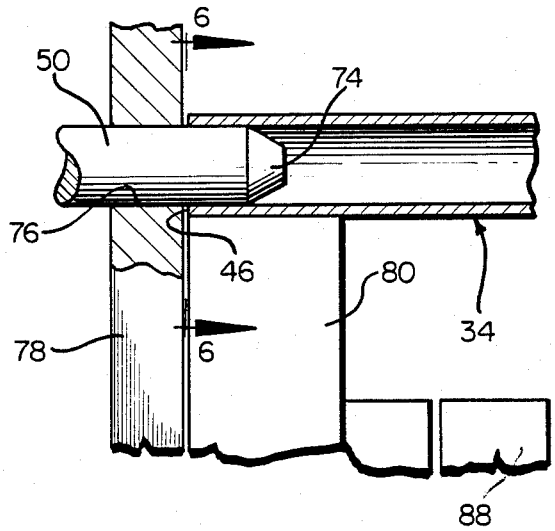
FIG. 4 is a fragmentary viewing similar to the showing of FIG. 3 but showing the dedimpler tool advanced into the end of the cut length of tubing.

With reference to FIGS. 3 and 4, the dedimpler tool 50 is fashioned with a cylindrical body and a conical tip 74, tip 74 being specifically provided in frusto-conical shape, in the illustrated embodiment, in order to facilitate progressive engagement with the dimpled end of the tube 34. Additionally, the dedimpler tool is sized to pass freely through an access aperture 76 which is drilled in a stationary stripper plate 78. The aperture 76 is sized to insure that the plate 78 engages the end edges of the tube 34 and prevents longitudinal movement of the tube with the dedimpler tool 50 upon retraction of the tool from the work station.

In order to support the wall material adjacent the cut end of a length of tubing 34 during the dedimpler action of tool 50, a backup pressure roller 80 is mounted on a shaft 82 in alignment with the working position of the tool 50, shaft 82 being supported for free rotation in cooperating bearings 84 and 86. The bearing 86 is fixed in an upright arm of an inboard support bracket 88, and the bearing 84 is secured in a bracket 90 which is attached to stripper plate 78 and which itself is fastened on the bed of the corresponding machine head, as is shown in FIG. 1.

Referring to FIG. 2, the feed ramp 32 which is associated with movable head 26 is embodied in a stationary, vertical plate 92, plate 92 being fashioned with upwardly opening notches and paired with a similar stationary, vertical plate 94, as is shown in FIG. 1. The plate 94 embodies the feed ramp 30 and is associated with the fixed machine head 24. In addition, each of the stationary plates 92 and 94 is connected to the housing of a gear box 96, and the housing of gear box 96 is, in turn, supported on the bed of the corresponding machine head by a foot extension 98.

In compliance with the features of the present invention, a walking-beam transfer mechanism or conveyer is provided to sequence individual tube lengths 34 from a position stacked behind the stop 36 (as is shown in FIG. 2), into processing engagement with the dedimpler tool 50, and onto a declined discharge ramp 100. Specifically and with reference to FIG. 1, two upright, laterally spaced walking-beams 102 and 104 are individually positioned outboard of the respective stationary, verticle plates 92 and 94 to be directed in closed, congruent, vertical, workpiece-transfer paths.

In particular, a pair of crank arms 106 is employed to provide an eccentric connection between each of the walking-beams and the gearing contained in the corresponding housing 96, the gearing being driven, in turn, by the pulsed, rotary drive force of an electrically energized, stepping motor and motion controller unit 108. Advantageously the unit 108 is selected to comprise a "SLO-SYN", MH Series, stepping motor and a "MODULYNX", Model DRD004, motion controller, manufactured by The Superior Electric Company, Bristol, Conn., and operated in the full-step mode with one revolution of the output shaft equivalent to one machine cycle.

Figure 7:
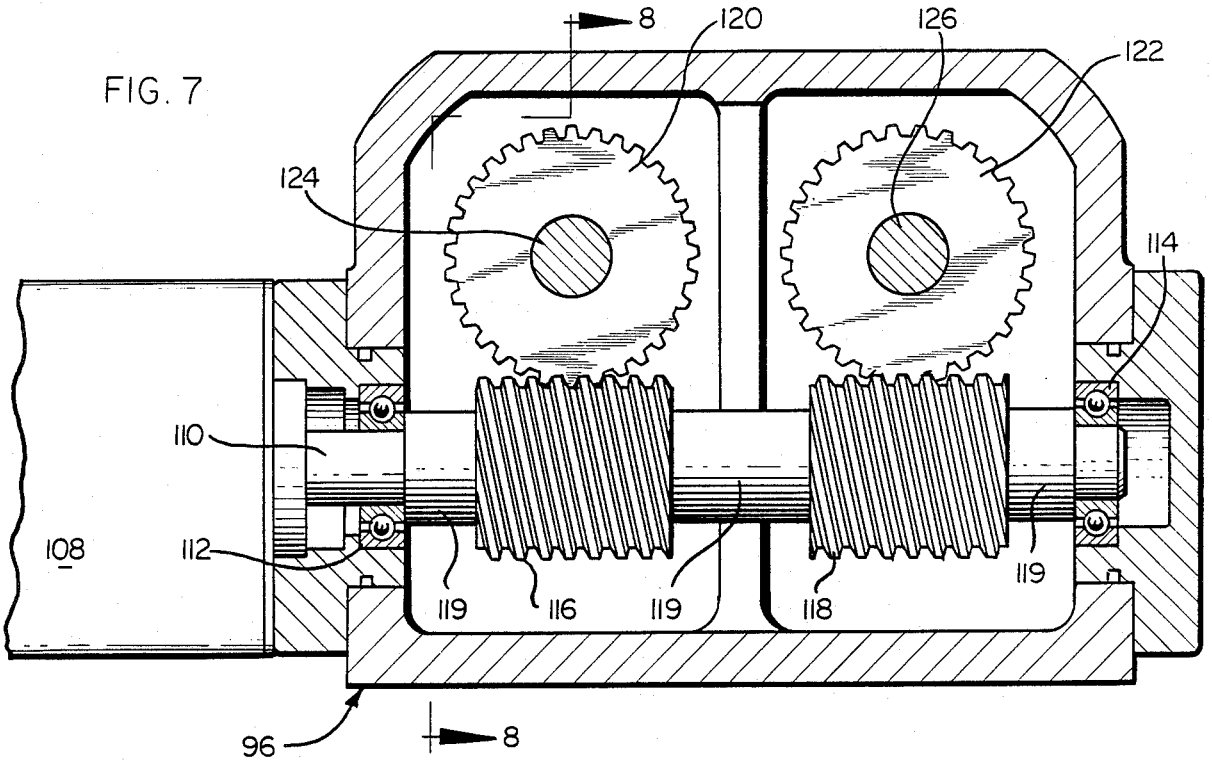
FIG. 7 is a central cross-sectional view of the gear arrangement used in driving the eccentrics incorporated in the walking-beam transfer mechanism.
Figure 8:
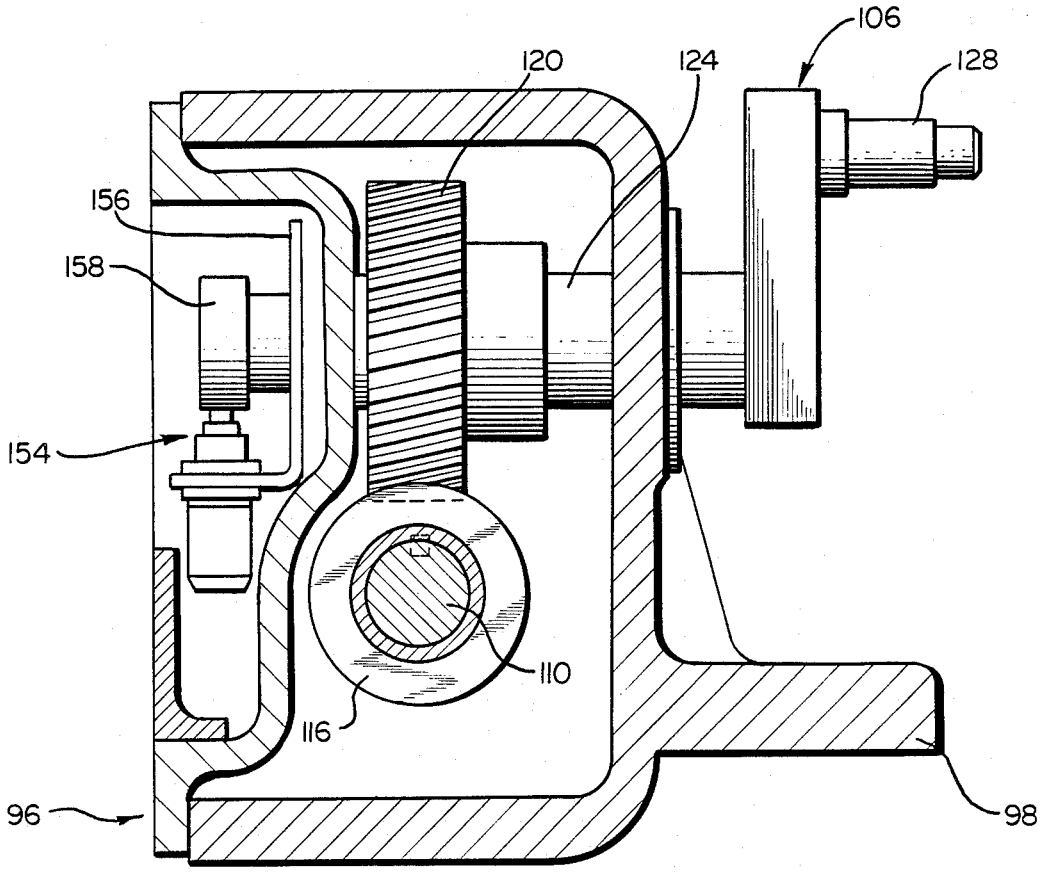
FIG. 8 is a sectional view taken substantially along the Line 8—8 of FIG. 7.

Referring to FIGS. 7 and 8, the motor-controller unit 108 provides an output shaft 110, shaft 110 being journalled in ball bearing elements 112 and 114 which are mounted inside gear housing 96 in spaced apart relationship. Two worm gears 116 and 118 are keyed on the shaft 110 and positioned in predetermined interval using spacers 119. The worm gears 116 and 118 mesh with companion worm wheels or gears 120 and 122 in order to transfer rotary drive force to transverse, double output shafts 124 and 126 upon which the worm wheels 120 and 122 have been secured. In one practical embodiment of the invention, the gearing 116, 118, 120 and 122 has been arranged to provide a 10:1 speed reduction.

With particular reference to FIG. 8, a crank arm 106 is non-rotatably mounted on each of the double output shafts 124 and 126; and a stub shaft 128 is welded to each of the crank arms 106 spaced apart from the corresponding double output shaft to define an eccentric. Turning to FIG. 2, the stub shafts 128 which are affixed to the companion crank arms 106 are themselves journalled in respective heel portions 130 and 132 of the walking-beam 102 in order to direct the walking-beam in the closed, congruent, vertical, workpiece-transfer path.

As the output shafts 124 and 126 are rotated, the stub shafts 128 traverse respective circular paths suggested by the arrows 134 and 136. This motion, in turn, causes the walking-beam to cycle from a nominal starting position indicated as 102A where the trailing notch 138 that is formed in the upper edge of the walking-beam can pick up the lowermost tube 34 from the stack collected behind the stop 36. At the zenith of its cycle, the walking-beam takes the position indicated as 102B where the several tubes 34 which are actively present in the dedimpling cycle have been raised above the notched, stationary plate 92. Continued rotation of the stub shafts 128 in the circular paths 134 and 136 lower the walking-beam into approximate horizontal alignment with the notched, stationary plate 92, indicated as 102C.

Continuing with reference to FIG. 2, each of the walking-beams 102 is fashioned with an upwardly opening discharge notch 140 and a medially disposed, upwardly open transfer notch 142, in addition to the input notch 138. The discharge notch 140 serves to transfer a dedimpled length of tubing 34 from the work station 28 which includes the dedimpler tool 50, and onto the discharge ramp 100. Cooperatively, the transfer notch 142 which is disposed interjacent the input notch 138 and the discharge notch 140, acts to advance the length of tubing 34 toward the work station.

The stationary plate 92 is cooperatively notched and specifically includes a dwell notch 144 and a dedimpler notch 146 which is disposed processwise downstream from the dwell notch 144. The notches 144 and 146 cooperate with the notches 138, 140 and 142 in cycling the tube lengths 34 through the dedimpler operation; and advantageously, a V-shaped tube saddle 148 is vertically adjustably positionably mounted on stationary plate 92 at the work station 28 in order to support a length of the tubing during the dedimpling procedure. For this purpose, tube saddle 148 is usefully fabricated from an anti-friction material and particularly from polytetrafluoroethylene resin. The V-shape of saddle 148 allows it to accept tubing of various diameters.

Returning to FIG. 2, the machine head 26 additionally includes an adjustably positionable hold-down bar or shoe 150 for use in advancing the dimpled tube lengths 34 in single-file fashion to the stop 36. Furthermore, a proximity switch 152 is mounted on the stationary plate 92 in position to sense the presence of a stack of dimpled tube lengths on the feed ramp 32 and to energize the circuits to the stepping motor and control unit 108 in response thereto. In addition and as will be seen in FIG. 8, a limit switch 154 is mounted adjacent the remote end of output shaft 124 by means of a bracket 156 in order to sense the angular position of the shaft. Cooperatively, a limit switch cam 158 is secured on the exposed end of shaft 124 to provide a mechanical signal to the switch 154 that the shaft has achieved a selected angular position associated with a dimpled tube length 34 having been deposited in the saddles 148 by the walking-beams 102 and 104. Upon its actuation by cam 158, switch 154 energizes the circuits to the dedimpler drive arrangement comprising the motor 56 and the cylinder 52. It will be appreciated that limit switch 154 may be combined with other limit switches to coordinate the cycling of the walking-beams 102 and 104.

In operation, the dedimpler apparatus 20 will be readied for use by first positioning the movable head 26 a suitable distance from the fixed head 24 to accommodate the particular length of cut tubing to be processed. A dedimpler tool 50 will also be selected of appropriate diameter to size the particular workpieces.

With the various drives connected to sources of motive power through suitable, conventional circuitry of the microprocessor type for example, dimpled lengths of cut tubing 34 will be fed down ramp 32, to the stop 36 and over the proximity switch 152. Switch 152, in response to the presence of the lengths of tubing, will then operate to activate the stepping motor and controller unit 108, causing the walking-beams 102 and 104 to cycle the lengths of tubing individually and in sequence toward residence in the saddles 148. As the end of each revolution of the shaft 124 is signalled by cam 158, limit switch 154 fires to energize the motor 56 and the cylinder 52 to advance and rotate the dedimpler plugs 50 through the stripper plate 78 and into the dimpled ends of the tubing.

Contact of limit switch 68 with stop 72 signals invagination of the tube ends by the dedimpler plugs and causes retraction of the plugs until switch 68 engages the stop 70 to de-energize both drive motor 56 and cylinder 52. Engagement of limit switch 68 and stop 70 also reactivates the stepping motor and controller unit 108 to recycle the walking-beams 102 and 104; and operation will thus continue.

As will be appreciated, the present invention provides a precision tube-feeding mechanism for use with dedimpler apparatus; and in specific embodiments, the present invention has achieved dedimpler processing speeds of from about 60 to over 80 pieces per minute in regular production operations. Moreover, it will be understood that the instant walking-beam transfer system can be easily retro-fit in existing dedimpler machines.

The drawings and the foregoing descriptions are not intended to represent the only form of the invention in regard to the details of its construction and manner of operation. Changes in form and in the proportion of parts as well as the substitution of equivalents, are contemplated as circumstances may suggest or render expedient; and although specific terms have been employed, they are intended in a generic and descriptive sense only and not for the purposes of limitation, the scope of the invention being delineated in the following claims.

The invention is claimed as follows:

1. In dedimpler apparatus for re-sizing the cut ends of tube lengths, the combination comprising: a pair of selectively convergibly and rotatably driven, conically tipped dedimpler tools and a tubing backup pressure roller aligned with the working position of each of said tools to cooperate in defining a pair of spaced dedimpler units in a work station; and a walking-beam transfer mechanism comprising a pair of laterally spaced, oscillatable beams having a plurality of upwardly opening, substantially V-shaped notches adapted to receive tubular workpieces and to positively space and transfer said workpieces in sequential order toward and away from the dedimpler units in said work station; crank means mechanically coupled to each of said beams for directing said beams in closed, congruent, vertical, workpiece-transfer paths; and drive means connected to each of said crank means for causing coordinated cycling of said beams through said paths.

2. A walking-beam transfer mechanism in the combination according to claim 1 wherein said drive means includes an electrically energized stepping motor.

3. A walking-beam transfer mechanism in the combination according to claim 2 which further includes electrical driver means for driving said stepping motor in the full-step mode.

4. A walking-beam transfer mechanism in the combination according to claim 1 which further comprises gear means connecting each of said drive means to the corresponding crank means.

5. A walking-beam transfer mechanism in the combination according to claim 4 wherein said gear means includes a pair of spaced output shafts and wherein said crank means includes an individual crank arm which is fixed on each of said output shafts and which is freely rotatably coupled to the corresponding oscillatable beam.

6. A walking-beam transfer mechanism in the combination according to claim 4 wherein said gear means includes a pair of spaced output shafts, a common input shaft, and a pair of meshed-worm-and-worm-gear sets individually connecting said input shaft to said output shafts.

7. A walking-beam transfer mechanism in the combination according to claim 1 wherein each of said oscillatable beams includes an upwardly opening discharge notch for transferring a dedimpled length of tubing from the work station, an upwardly opening input notch for picking up the lead length of tubing to be processed from a feed ramp, and an upwardly opening transfer notch disposed interjacent said discharge notch and said input notch for advancing a length of tubing to be processed toward said work station.

8. A walking-beam transfer mechanism in the combination according to claim 7 which further comprises a stationary plate disposed adjacent each of said oscillatable beams parallel therewith and having upwardly opening notches defining sequential, tube-rest positions for cooperation with said beam notches in processing tube lengths through said apparatus.

9. A walking-beam transfer mechanism in the combination according to claim 8 which further comprises tube saddle means vertically adjustably positionably mounted on each of said stationary plates at said work station to support a length of tubing during the dedimpling procedure.

10. A walking-beam transfer mechanism in the combination according to claim 9 wherein said saddle means is fabricated from antifriction material.

11. A walking-beam transfer mechanism in the combination according to claim 10 wherein said antifriction material is polytetrafluoroethylene resin.

* * * * *